US006925660B1

(12) United States Patent
Cartwright

(10) Patent No.: US 6,925,660 B1
(45) Date of Patent: Aug. 9, 2005

(54) SHAMPOO BOWL ASSEMBLY AND SHAMPOO BOWL CUSHION

(76) Inventor: Ann Cartwright, 4255 N. Brown, Scottsdale, AZ (US) 85251

( * ) Notice: Subject to any disclaimer, the term of this patent is extended or adjusted under 35 U.S.C. 154(b) by 0 days.

(21) Appl. No.: 10/650,001

(22) Filed: Aug. 27, 2003

(51) Int. Cl.[7] ..... A45D 44/10
(52) U.S. Cl. ..... 4/523; 4/580
(58) Field of Search ..... 4/523, 580–583

(56) References Cited

U.S. PATENT DOCUMENTS 6,230,338 B1 * 5/2001 Kirsch ..... 4/523
2001/0034907 A1 * 11/2001 Bullock ..... 4/580

* cited by examiner

*Primary Examiner*—Charles E. Phillips
(74) *Attorney, Agent, or Firm*—Parsons & Goltry; Michael W. Goltry; Robert A. Parsons

(57) ABSTRACT

A cushioning device fur use with a shampoo bowl including a front wall having an inner surface and an outer surface, and a U-shaped, neck-receiving notch in the front wall. The cushioning device includes a flexible cushion constructed of a matrix of formed cushioning pockets separated by seams. The flexible cushion includes opposing proximal and distal extremities and a waist therebetween. The waist is adapted to overlie a segment of the U-shaped, neck receiving notch, the proximal extremity is adapted to overlie and secure a portion of the inner surface of the front wall, and the distal extremity is adapted to overlie a secure portion of the outer surface of the front wall.

20 Claims, 3 Drawing Sheets

SHAMPOO BOWL ASSEMBLY AND SHAMPOO BOWL CUSHION

FIELD OF THE INVENTION

This invention relates to salon equipment, and, more particularly, to shampoo bowls and to cushioning devices for shampoo bowls.

BACKGROUND OF THE INVENTION

A shampoo bowls is a specialized device that has a basin having a U-shaped, neck-receiving notch formed therein for receiving the neck of a user so as to position the user's head in the basin so that the user's hair can be washed by a hair stylist, a hair care specialist, a barber, etc. In an effort to protect patrons' necks from the hard surface of the U-shaped notch of shampoo bowls, skilled artisans have developed various devices adapted to fit into the U-shaped notch for providing cushioning. Although the art is replete with various types of devices adapted to fit in the U-shaped notch of shampoo bowls to provide cushioning against the hard surface of the notch, they are either difficult to construct, become easily fowled with cleaning preparations, and fail to incorporate structure that is designed to conduct water and fluid away from the patron's neck and into the basin of the shampoo bowl. Given these and other deficiencies in the art, the need for certain new and useful improvements is evident.

SUMMARY OF THE INVENTION

Disclosed is a cushioning device adapted for attachment to a shampoo bowl including a front wall having an inner surface and an outer surface, and a U-shaped, neck-receiving notch in the front wall. The cushioning device consists of a flexible cushion constructed of a matrix of formed cushioning pockets separated by seams. The flexible cushion has opposing proximal and distal extremities and a waist therebetween. The waist is adapted to overlie a segment of the U-shaped, neck receiving notch, the proximal extremity is adapted to overlie a portion of the inner surface of the front wall, and the distal extremity is adapted to overlie a portion of the outer surface of the front wall. The cushioning pockets are adapted to provide a cushioning effect, and the seams are adapted to provide fluid conducting channels or grooves. In a preferred embodiment, the proximal and distal extremities of the cushion are enlarged relative to the waist and to the U-shaped, neck-receiving notch. In one embodiment, the pockets are filled with air. In another embodiment, the pockets are filled with viscous gel material. The proximal extremity is to be detachably secured to the inner surface of the front wall of the shampoo bowl, and the distal extremity of the flexible cushion is to be detachably secured to the outer surface of the front wall of the shampoo bowl. In a preferred embodiment, the proximal extremity of the flexible cushion is fashioned with at least one attached suction cup for providing a suction cup coupling to the inner surface of the front wall of the shampoo bowl. In another embodiment, there is provided a hook medium attached to one of the inner surface of the front wall of the shampoo bowl and the proximal extremity of the flexible cushion device, and a detachably engagable loop medium attached to the other one of the inner surface of the front wall of the shampoo bowl and the proximal extremity of the flexible cushion. In a preferred embodiment, the distal extremity of the flexible cushion is fashioned with at least one attached suction cup for providing a suction cup coupling to the outer surface of the front wall of the shampoo bowl. In another embodiment, there is provided a hook medium attached to one of the outer surface of the front wall of the shampoo bowl and the distal extremity of the flexible cushion, and a detachably engagable loop medium attached to the other one of the outer surface of the front wall of the shampoo bowl and the distal extremity of the flexible cushion.

Also disclosed is a shampoo bowl assembly consisting of a shampoo bowl including a front wall having an inner surface and an outer surface, a U-shaped, neck-receiving notch in the front wall, and an attached flexible cushion. The flexible cushion has opposing proximal and distal extremities and a waist therebetween, and is fashioned of a matrix of formed cushioning pockets separated by seams. The waist is positioned so as to overlie a segment of the U-shaped, neck receiving notch, the proximal extremity is positioned so as to overlie a portion of the inner surface of the front wall, and the distal extremity is positioned so as to overlie a portion of the outer surface of the front wall. The cushioning pockets are adapted to provide a cushioning effect, and the seams are adapted to provide fluid conducting channels or grooves. In a preferred embodiment, the proximal and distal extremities of the cushion are enlarged relative to the waist and to the U-shaped, neck-receiving notch. In one embodiment, the pockets are filled with air. In another embodiment, the pockets are filled with viscous gel material. The proximal extremity is detachably secured to the inner surface of the front wall of the shampoo bowl, and the distal extremity of the flexible cushion is detachably secured to the outer surface of the front wall of the shampoo bowl. In a preferred embodiment, the proximal extremity of the flexible cushion is fashioned with at least one attached suction cup providing a suction cup coupling to the inner surface of the front wall of the shampoo bowl. In another embodiment, there is provided a hook medium attached to one of the inner surface of the front wall of the shampoo bowl and the proximal extremity of the flexible cushion device, and a loop medium attached to the other one of the inner surface of the front wall of the shampoo bowl and the proximal extremity of the flexible cushion, in which the hook and loop medium are engaged to one another detachably engaging the proximal extremity of the flexible cushion to the inner surface of the shampoo bowl. In a preferred embodiment, the distal extremity of the flexible cushion is fashioned with at least one attached suction cup providing a suction cup coupling to the outer surface of the front wall of the shampoo bowl. In another embodiment, there is provided a hook medium attached to one of the outer surface of the front wall of the shampoo bowl and the distal extremity of the flexible cushion, and a loop medium attached to the other one of the outer surface of the front wall of the shampoo bowl and the distal extremity of the flexible cushion, in which the hook and loop medium are engaged to one another detachably engaging the distal extremity end of the flexible cushion to the outer surface of the shampoo bowl.

In a shampoo bowl including a front wall having an inner surface and an outer surface, and a U-shaped, neck-receiving notch in the front wall, also disclosed is a method consisting of 1) providing a flexible cushion constructed of a matrix of formed cushioning pockets separated by seams that form recesses, channels or grooves, the flexible cushion including opposing proximal and distal extremities and a waist therebetween; 2) positioning the waist so as to overlie a segment of the U-shaped, neck receiving notch, positioning the proximal extremity so as to overlie a portion of the inner surface of the front wall, and positioning the distal extremity so as to overlie a portion of the outer surface of the front wall; 3) securing the proximal extremity of the cushion to the inner surface of the front wall of the shampoo bowl; 4) and securing the distal extremity of the cushion to the outer surface of the front wall of the shampoo bowl; wherein the pockets and the seams are directed away from the shampoo bowl. In a preferred embodiment, the proximal and distal extremities of the cushion are enlarged relative to the waist and to the U-shaped, neck-receiving notch. In one embodiment, the pockets are filled with air. In another embodiment, the pockets are filled with viscous gel material.

Consistent with the foregoing summary of preferred embodiments of the invention and the ensuing specification, which are intended to be taken together, the invention also contemplates associated apparatus and method embodiments.

BRIEF DESCRIPTION OF THE DRAWINGS

Referring to the drawings.

DETAILED DESCRIPTION OF A PREFERRED EMBODIMENT

Figure 1:
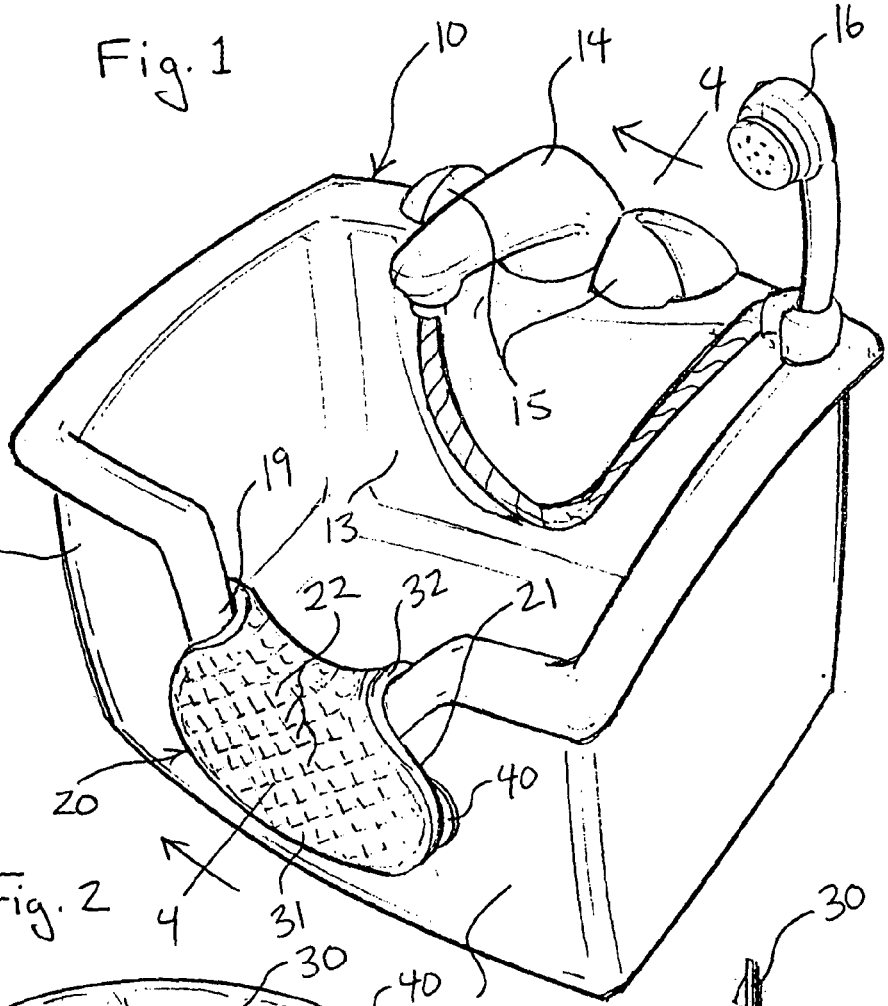
FIG. 1 is an isometric view of a cushioning device arranged of a U-shaped notch in front wall of a shampoo bowl.
Figure 4:
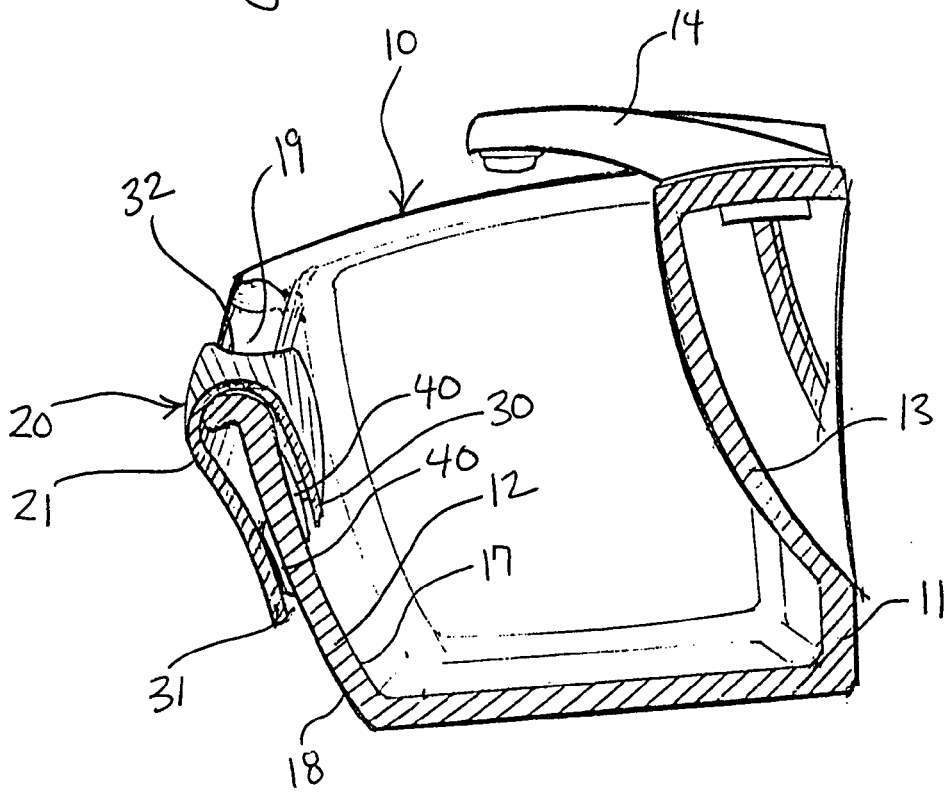
FIG. 4 is a sectional view taken along line 4—4 of FIG. 1.

Turning now to the drawings, in which like reference characters indicate corresponding elements throughout the several views, attention is first directed to FIG. 1 in which there is seen a shampoo bowl 10 and an attached cushioning device 20. Shampoo bowl 10 consists of a wash basin 11 having a front wall 12, an opposing back wall 13, and a faucet 14 including hot and cold water controls 15 and an attached spray head 16. With additional reference to FIG. 4, front wall 12 has inner and outer surfaces 17 and 18 (inner surface 17 shown only in FIG. 4), and a U-shaped, neck-receiving notch 19.

Set forth for purposes of orientation and reference in connection with the ensuing detailed description of the preferred embodiment of the instant invention, the foregoing brief description of shampoo bowl 10 is intended to be generally representative of a typical shampoo bowl. Details not specifically illustrated and described will be readily understood and appreciated by those skilled in the art.

Figure 3:
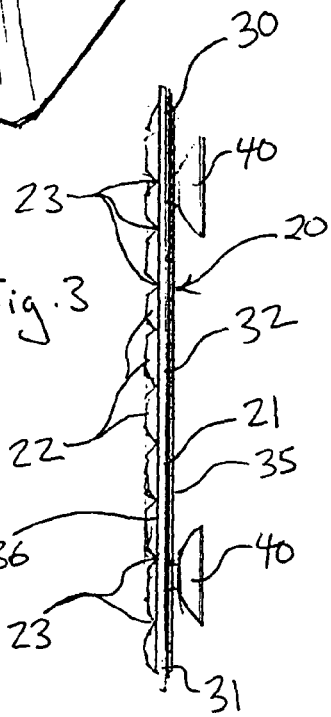
FIG. 3 is a side elevational view of the cushioning device of FIG. 1, the opposing side elevational view being a substantial mirror image.
Figure 7:
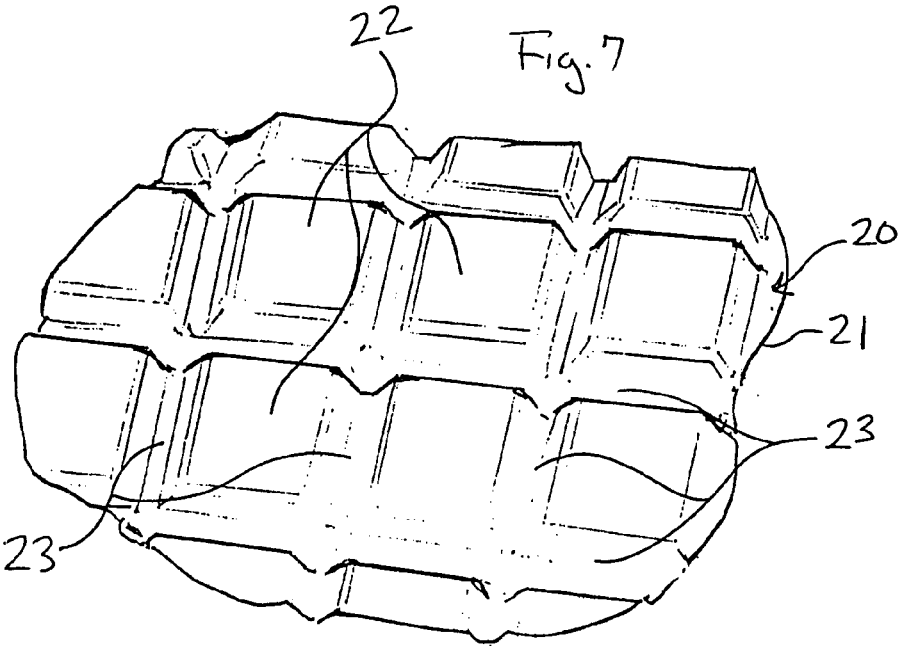
FIG. 7 is an enlarged fragmented isometric view of the flexible cushion of FIG. 1 illustrating a pattern of pockets and recesses.

Cushioning device 20 consists of a flexible cushion 21, which in shape is wide and relatively flat that consists of, as best seen in FIGS. 3 and 7, a matrix of formed cushioning pockets 22 that are separated by seams 23, which act as living hinges providing cushion 21 with tremendous flexibility and formability. The material defining pockets 22 and seams 23 is, in a preferred embodiment, low density polyethylene or other similar plastic or plastic-like water-repellent material or combination of water-repellant materials. Seams 23 define recess, channels or grooves.

Figure 5:
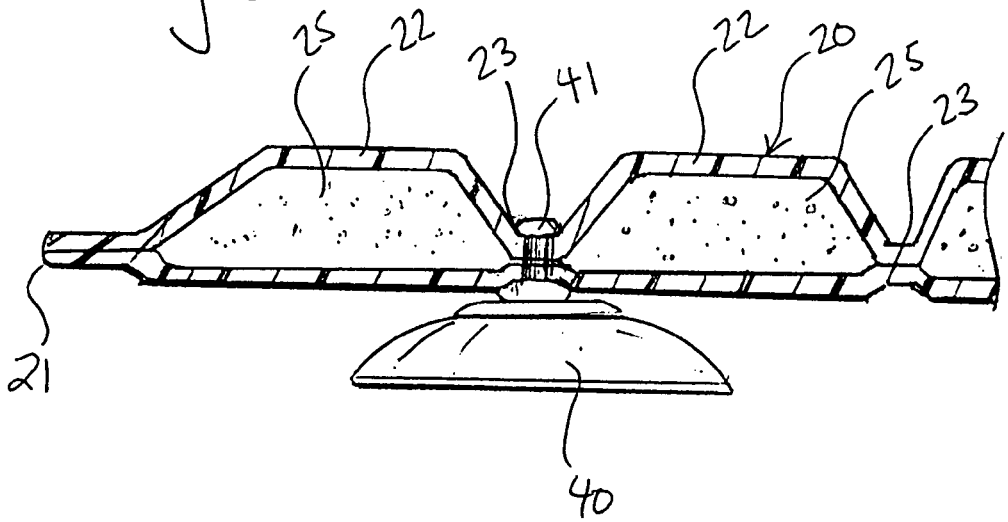
FIG. 5 is a vertical sectional view of a segment of the cushioning device of FIG. 1 illustrating pockets thereof with recesses therebetween, and an attached suction cup.

Turning momentarily to FIG. 5, there is seen an enlarged vertical sectional view of cushion 21 illustrating adjacent pockets 22 and seams 23 therebetween. Seams 23 are formed seams between pockets 22. In one embodiment, pockets 22 are filled with air or other selected gas, such as Nitrogen or Argon or the like, or combination of gases. In another embodiment, pockets 22 are filled with viscous gel material, such as readily available thermally conductive gel material, or other high viscosity gel or gel-like material commonly used in connection with readily available gel packs, and this is preferred. Accordingly, reference character 25 in FIG. 5 is intended to denote viscous gel material disposed in, and contained by, pockets 22. Other cushioning material can be used to fill pockets 22, such as silica gel, beads, sand, etc. Cushions that consist of a matrix of pockets of gas or gel or other cushioning material, which are separated by seams, are well-known in the art, and this specific aspect of cushion 21 is intended to be generally representative of such well-known cushion structures. Further details of this specific aspect of cushion 21 not specifically illustrated and described will be readily understood and appreciated by those skilled in the art.

Figure 2:
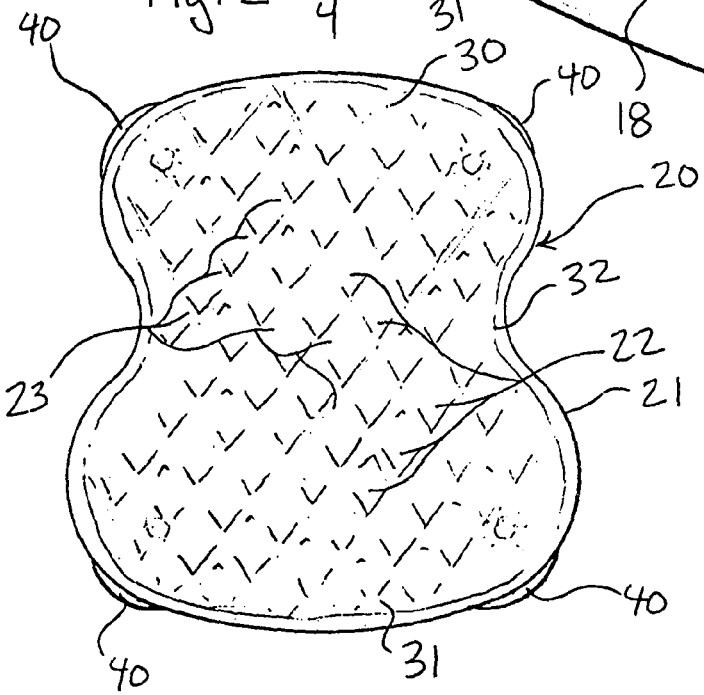
FIG. 2 is a top plan of the cushioning device of FIG. 1.
Figure 8:
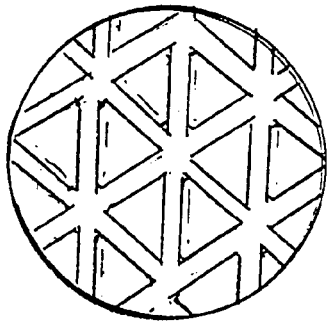
FIG. 8 is an example of another pattern of pockets and recesses for a cushioning device constructed and arranged in accordance with the invention.

Looking to FIG. 2, cushion 21 has, in accordance with the principle of the invention, opposing proximal and distal extremities 30 and 31, and a waist 32 therebetween. Although cushion 21 is highly flexible, FIG. 3 depicts cushion 21 in a flattened state for the purpose of illustrating its opposing major faces 35 and 36, in which face 35 is considered an inner face of cushion 21 and face 36 is considered an outer face of cushion. As shown in FIG. 3, pockets 22 project outwardly from face 36, in which seams 23, which constitute recessed channels or grooves between pockets 22, are disposed at face 36. Referring back to FIG. 7, pockets 22 are generally equal in size and are disposed in essentially a checkerboard pattern. As a result of this checkerboard pattern of pockets 22, seams 23 define a plurality of spaced-apart parallel first recesses or channels or grooves that, for the purpose of orientation, reside along parallel X-axes, and a plurality of spaced-apart parallel second recesses or channels or grooves that, for the purpose of orientation, reside along parallel Y-axes. The parallel first axes and the parallel second axes, which are disposed essentially in a criss-cross pattern as governed by the checkerboard disposition of pockets 22, intersect at generally right angles, as shown. Consistent with the teachings of this disclosure, other patterns for pockets 22 and seams 23 can be used, if desired, such as a diamond pattern, a triangular pattern as depicted in FIG. 8, etc.

In use, cushion 21 is taken up and attached to shampoo bowl 10 so as to provide cushioning at notch 19. In accordance with the invention, face 35 is presented against shampoo bowl 20 so as to direct pockets 22 and seams 23 away from shampoo bowl 10. Looking to FIGS. 1 and 4, neck 32 is positioned so as to overly notch 19, proximal extremity 30 is directed into basin 11 so as to overly a portion of inner surface 17 of front wall 12 underlying notch 19, and distal extremity 31 is directed outwardly from basin 11 so as to overly a portion of outer surface 18 of front wall 12 underlying notch 19. The inherent and exemplary flexibility and formability of cushion 21 as provided by its construction as previously explained causes waist 32 to conform to the U-shape of notch 19 and causes proximal and distal extremities 30 and 31 to fold over basin 11 and drape downwardly along either side of notch 19. After cushion 21 is so installed, a user may direct his head into basin 11 and rest his neck in notch 19 against waist 32.

Proximal and distal extremities 30 and 31 of cushion 21 are substantially equally sized and shape, and are each enlarged, i.e., wider, relative to waist 32, and this aspect is readily depicted in FIG. 2. The narrowed constitution of waist 32 is important, as it adapts and arranges waist 32 to fit competently and snugly into notch 19 so as to provide a cushioning effect at notch 19 for a user to enjoy when his neck is positioned thereon during use of shampoo bowl. The enlarged constitution of proximal and distal extremities 30 and 31 is also important, as it provides the proximal and distal extremities 30 and 31 with ballast that improves the stability of cushion 21 as it sits against shampoo bowl 10, and prevents cushion 21 from inadvertently falling both into basin 11 and outwardly from basin 11 as proximal and distal extremities 30 and 31 are also enlarged relative to notch 19. Pockets 22, which are directed outwardly, function to provide a cushioning effect for a user's neck positioned thereon at notch 19. Seams 23 are important as they function as fluid conducting recesses or channels or grooves that conduct water away from the users neck and downwardly into basin 11 during use of shampoo bowl 10, namely, when the user is having his hair washed by a hair care specialist, a hair stylist, etc. It is to be understood that when cushion 21 is installed with a shampoo bowl as herein described, seams 23 carried by cushion 21 from waist 32 to proximal extremity 30 are constructed and arranged to direct fluid into basin 11 and away from the neck of a patron positioned resting in notch 19 against waist 32 of cushion 21. This same discussion applies also when the installation of cushion 21 is reversed, in which proximal extremity 30 is directed out of shampoo bowl 10 and distal extremity 31 is directed into shampoo bowl 10. In this installation of cushion 21, distal extremity 31 can be considered the proximal extremity of cushion 21, and proximal extremity 30 can be considered the distal extremity of cushion 21.

Cushion 21 incorporates structure for detachably securing it in place to shampoo bowl 10 and, more particularly, for detachably securing proximal extremity 30 to inner surface 17 of front wall 12 of shampoo bowl 10, and for detachably securing distal extremity 31 of cushion 21 to outer surface 18 of front wall 12 of shampoo bowl 10. In a preferred embodiment, cushion is provided with suction cups 40 as seen in FIGS. 2 and 3. Looking specifically to FIG. 3, suction cups 40 are attached to cushion 21 and project away from face 35. In this immediate embodiment, proximal extremity 30 is fashioned with two opposing suction cups 40 that are disposed on either side of proximal extremity 30, although less or more can be used. Distal extremity 31 is also fashioned with a two opposing suction cups 40 that are disposed on either side of distal extremity 31, although less or more can be used. Suction cups 40 are conventional and are substantially identical, in which one is shown in detail in FIG. 5. Suction cup 40 is attached to a rivet 41 that is riveted to cushion 21 at one of seams 23. Other ways of securing suction cup 40 to cushion 21 can be used, such as adhesive attachment, a pinned attachment, etc. To secure proximal extremity 30 to shampoo bowl 10, a user need only apply its attached suction cups 40 against inner surface 17 of front wall 12. To secure distal extremity 31 to shampoo bowl 10, a user need only apply its attached suction cups 40 against outer surface 18 of front wall 12. To remove cushion 21 from shampoo bowl 10, one need only apply take up cushion 21, such as by hand, and apply a forcible impulse to cushion 21 that is sufficient to overcome the suction cup coupling of suction cups 40.

Figure 6:
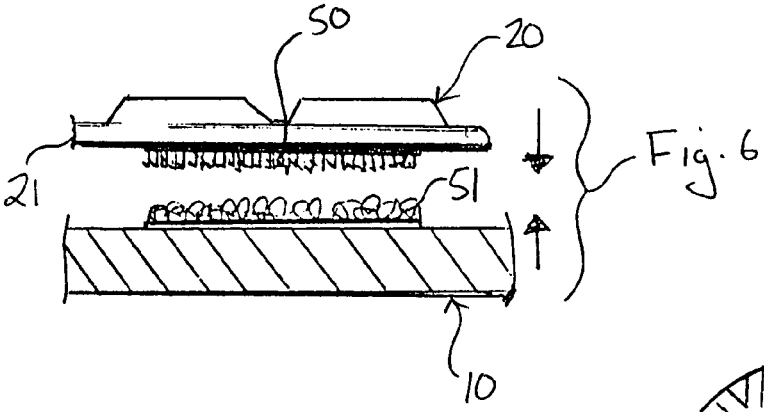
FIG. 6 is illustrative of a hook and loop fastening assembly for use in attaching the cushioning device of FIG. 1 to a shampoo bowl.

Although suction cups 40 are preferred for detachably securing cushion 21 to shampoo bowl 10 as herein described, other types of fastening mechanisms can be used such as mutual snap fasteners, water-proof adhesive, etc. As a matter of example, FIG. 6 illustrates a segment of cushion 21 and a segment of shampoo bowl 10, in which there is a hook medium 50 attached (such as with adhesive) to face 35 of cushion 21 and a detachably engagable loop medium 51 attached (such as with adhesive) to shampoo bowl 10, in which a detachable engagement of cushion 21 is provided when hook medium 50 brought into engagement with loop medium 51. Although in the instant example hook medium 50 is attached to cushion 21 and loop medium 51 is attached to shampoo bowl 10, this can be reversed, if desired. A hook and loop fastening pair can be used in lieu of each of suction cups 40, if desired.

The invention has been described above with reference to a preferred embodiment. However, those skilled in the art will recognize that changes and modifications may be made to embodiment without departing from the nature and scope of the invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

What is claimed is:

1. A cushioning device adapted for attachment to a shampoo bowl including a front wall having an inner surface and an outer surface, and a U-shaped, neck-receiving notch in the front wall, the cushioning device comprising:

a flexible cushion constructed of a matrix of formed cushioning pockets separated by seams, the flexible cushion including an inner face, an opposing outer face, and opposing enlarged proximal and distal extremities and a narrowed waist therebetween;

the cushioning pockets projecting outwardly from the outer face and the seams located at the outer face;

the waist adapted to overlie a segment of the U-shaped, neck receiving notch, the proximal extremity adapted to overlie a portion of the inner surface of the front wall, and the distal extremity adapted to overlie a portion of the outer surface of the front wall;

first means for detachably securing the proximal extremity of the cushion to the inner surface of the front wall; and second means for detachably securing the proximal distal extremity of the cushion to the outer surface of the front wall;

wherein the cushioning pockets provide a cushioning effect at the outer face of the cushion, and the seams provide fluid conducting channels at the outer face of the cushion for conducting water away from the waist of the cushion.

2. The cushioning device of claim 1, wherein the proximal and distal extremities of the cushion are enlarged relative to the waist and to the U-shaped, neck-receiving notch.

3. The cushioning device of claim 1, wherein the pockets are filled with air.

4. The cushioning device of claim 1, wherein the pockets are filled with viscous gel material.

5. The cushioning device of claim 1, wherein the first means comprises at least one suction cup attached to the proximal extremity of the flexible cushion for providing a suction cup coupling to the inner surface of the front wall of the shampoo bowl.

6. The cushioning device of claim 1, wherein the first means comprises:

a hook medium attached to one of the inner surface of the front wall of the shampoo bowl and the proximal extremity of the flexible cushion; and a detachably engagable loop medium attached to the other one of the inner surface of the front wall of the shampoo bowl and the proximal extremity of the flexible cushion.

7. The cushioning device of claim 1, wherein the second means comprises at least one suction cup attached to the distal extremity of the flexible cushion for providing a suction cup coupling to the outer surface of the front wall of the shampoo bowl.

8. The cushioning device of claim 1, wherein the second means comprises:

a hook medium attached to one of the outer surface of the front wall of the shampoo bowl and the distal extremity of the flexible cushion; and a detachably engagable loop medium attached to the other one of the outer surface of the front wall of the shampoo bowl and the distal extremity of the flexible cushion.

9. A shampoo bowl assembly comprising:

a shampoo bowl including a front wall having an inner surface and an outer surface, and a U-shaped, neck-receiving notch in the front wall;

a flexible cushion constructed of a matrix of formed cushioning pockets separated by seams, the flexible cushion including an inner face, an opposing outer face, and opposing enlarged proximal and distal extremities and a narrowed waist therebetween;

the cushioning pockets projecting outwardly from the outer face and the seams located at the outer face;

the waist overlying a segment of the U-shaped, neck receiving notch, the proximal extremity overlying a portion of the inner surface of the front wall, and the distal extremity overlying a portion of the outer surface of the front wall;

the inner face of the cushion facing the shampoo bowl;

the outer face of the cushion, the cushioning pockets, and the seams directed away from the shampoo bowl;

first means for detachably securing the proximal extremity of the cushion to the inner surface of the front wall; and second means for detachably securing the proximal distal extremity of the cushion to the outer surface of the front wall;

wherein the cushioning pockets provide a cushioning effect at the outer face of the cushion, and the seams provide fluid conducting channels at the outer face of the cushion for conducting water away from the waist of the cushion.

10. The shampoo bowl assembly of claim 9, wherein the proximal and distal extremities of the cushion are enlarged relative to the waist and to the U-shaped, neck-receiving notch.

11. The shampoo bowl assembly of claim 9, wherein the pockets are filled with air.

12. The shampoo bowl assembly of claim 9, wherein the pockets are filled with viscous gel material.

13. The shampoo bowl assembly of claim 9, wherein the first means comprises at least one suction cup attached to the proximal extremity of the flexible cushion providing a suction cup coupling to the inner surface of the front wall of the shampoo bowl.

14. The shampoo bowl assembly of claim 9, wherein the first means comprises:

a hook medium attached to one of the inner surface of the front wall of the shampoo bowl and the proximal extremity of the flexible cushion;

a loop medium attached to the other one of the inner surface of the front wall of the shampoo bowl and the proximal extremity of the flexible cushion; and the hook medium detachably securing the loop medium.

15. The shampoo bowl assembly of claim 9, wherein the second means comprises at least one suction cup attached to the distal extremity of the flexible cushion providing a suction cup coupling to the outer surface of the front wall of the shampoo bowl.

16. The shampoo bowl assembly of claim 9, wherein the second means comprises:

a hook medium attached to one of the outer surface of the front wall of the shampoo bowl and the distal extremity of the flexible cushion;

a loop medium attached to the other one of the outer surface of the front wall of the shampoo bowl and the distal extremity of the flexible cushion; and the hook medium detachably securing the loop medium.

17. In a shampoo bowl including a front wall having an inner surface and an outer surface, and a U-shaped, neck-receiving notch in the front wall, a method comprising steps of:

providing a flexible cushion constructed of a matrix of formed cushioning pockets separated by seams, the flexible cushion including an inner face, an opposing outer face, and opposing enlarged proximal and distal extremities and a narrowed waist therebetween;

the cushioning pockets projecting outwardly from the outer face and the seams located at the outer face;

directing the inner face of the cushion toward the shampoo bowl and positioning the waist so as to overlie a segment of the U-shaped, neck receiving notch, positioning the proximal extremity so as to overlie a portion of the inner surface of the front wall, and positioning the distal extremity so as to overlie a portion of the outer surface of the front wall;

the outer face of the cushion, the cushioning pockets, and the seams directed away from the shampoo bowl;

securing the proximal extremity of the cushion to the inner surface of the front wall of the shampoo bowl; and securing the distal extremity of the cushion to the outer surface of the front wall of the shampoo bowl;

wherein the cushioning pockets and the seams are directed away from the shampoo bowl in which the cushioning pockets provide a cushioning effect at the outer face of the cushion, and the seams provide fluid conducting channels at the outer face of the cushion for conducting water away from the waist of the cushion.

18. The method of claim 17, wherein the proximal and distal extremities of the cushion are enlarged relative to the waist and to the U-shaped, neck-receiving notch.

19. The method of claim 17, wherein the pockets are filled with air.

20. The method of claim 17, wherein the pockets are filled with viscous gel material.

* * * * *